United States Patent [19]

Hsu

[11] Patent Number: 5,069,339

[45] Date of Patent: Dec. 3, 1991

[54] STRUCTURE OF CLIP CONTAINER

[76] Inventor: Nick Hsu, 5 F, No. 44, Alley 3, Lane 550, Min Chuan E. Rd., Taipei, Taiwan

[21] Appl. No.: 627,144

[22] Filed: Dec. 13, 1990

[51] Int. Cl.[5] ..... B65D 83/00

[52] U.S. Cl. ..... 206/340; 206/818; 221/212

[58] Field of Search ..... 206/338, 340, 350, 818; 221/212

[56] References Cited

U.S. PATENT DOCUMENTS

| | | | |
|---|---|---|---|
| 3,269,528 | 8/1960 | Leedy | 206/338 |
| 3,704,991 | 12/1972 | Leedy | 206/338 |
| 3,743,082 | 7/1973 | Herrmann | 206/338 |
| 3,750,868 | 8/1973 | Cooper | 206/338 |
| 3,831,743 | 8/1974 | Leedy | 206/338 |
| 4,058,209 | 11/1977 | Schmidt | 206/338 |
| 4,986,417 | 1/1991 | Hsu | 206/818 |

FOREIGN PATENT DOCUMENTS

| | | | |
|---|---|---|---|
| 0114335 | 6/1969 | Denmark | 206/338 |
| 1409537 | 10/1975 | United Kingdom | 206/350 |

*Primary Examiner*—Jimmy G. Foster

*Attorney, Agent, or Firm*—Varndell Legal Group

[57] ABSTRACT

A clip container comprising a casing mounted on a base for holding clips. The casing has an annular top edge around the periphery thereof and an inner concave surface portion for holding clips. The concave surface portion has a hollow, conical projection at its center. The base has a raised wall around the periphery and a post at the center respectively for supporting the annular top edge and the hollow, conical projection. Magnetic elements are mounted on the top edge of the raised wall and the hollow, conical projection to attract clips to the annular top edge or the hollow, conical projection for easy grasping.

12 Claims, 4 Drawing Sheets

STRUCTURE OF CLIP CONTAINER

BACKGROUND OF THE INVENTION

The present invention relates to clip containers, and, more particularly, relates to a clip container which comprises a casing covered on a base for keeping clips, permitting clips to be attracted to an annular top edge or a hollow, conical projection by magnetic force for easy grasping.

FIG. 1 illustrates a structure of clip case according to the prior art, having a casing for keeping clips and covered with a cover. The cover has an opening at the center, and a magnetic element is fastened around said opening. When in use, the case is held in the hand with the palm of the hand stopping at the opening, and then it is turned upside-down permitting a certain number of clips to be attracted to the edge of the opening by the magnetic element. When the case is turned upside-down, clips may fall out of the case easily. Each time the case is turned upside-down, a plurality of clips may be disorderly attracted by the magnetic element to block up the opening, and therefore, the clips which are attracted to the opening must be properly arranged with fingers.

FIG. 2 illustrates another structure of clip case according to the prior art, having a casing for keeping clips and covered with a cover. In this structure, the casing has a post at the center and disposed at a level slightly below the opening of the cover, which post has a magnetic element fastened at the top for attracting a small number of clips. When the case is turned upside-down, only few clips will be attracted to the post for grasping, and therefore, the opening of the cover will not be blocked by clips. However, clips still may fall out of the case when it is turned upside-down.

In Chinese Patent No. 49335, there is disclosed another type of clip case which comprises an actuating rod controlled to attract clips from the case for grasping when the cover is pressed down. This structure is more complicated and difficult to assemble.

In Chinese Patent No. 55131, there is disclosed another structure of clip case which comprises a rotary wheel which can be rotated to attract clips out of the case for grasping. In Chinese Patent Gazette Publication No. 139664, there is disclosed a clip case having a structure similar to the clip case disclosed in the Chinese Pat. No. 55131. In these two structures of clip case, clips can only be carried out of the case in a fixed direction. These two structures of clip case are complicated and expensive to manufacture.

In German Patent DE 3729572 A1, there is disclosed a clip case which comprises a cover pivoted to a clip container at one end. The cover has a magnetic means at the inside for attracting clips. When the cover is pressed to open, a large number of clips are disorderly attracted by the magnetic means. The clips gathered at the magnetic means on the inside of the cover may project outwards to obstruct the rotation of the cover on the case. Further, because the case is designed in a rectangular shape, it must be inclined for permitting the clips at the inner side within the case to fall toward to the opening, so that the clips can be effectively attracted by the magnetic means.

SUMMARY OF THE INVENTION

The present invention has been accomplished to eliminate the aforesaid problems. It is therefore an object of the present invention to provide a clip case which is simple in structure, inexpensive to manufacture and practical in use. According to the present invention, there is provided a clip case having an annular top edge around the periphery thereof defining therein a concave surface portion for keeping clips, which concave surface portion has a hollow, conical projection at the center. Magnetic elements are respectively fastened inside the annular top edge and the hollow, conical projection for attracting clips which are moved by fingers from the concave surface portion toward the annular top edge or the hollow, conical projection.

DETAILED DESCRIPTION OF THE PREFERRED EMBODIMENT

Figure 1:
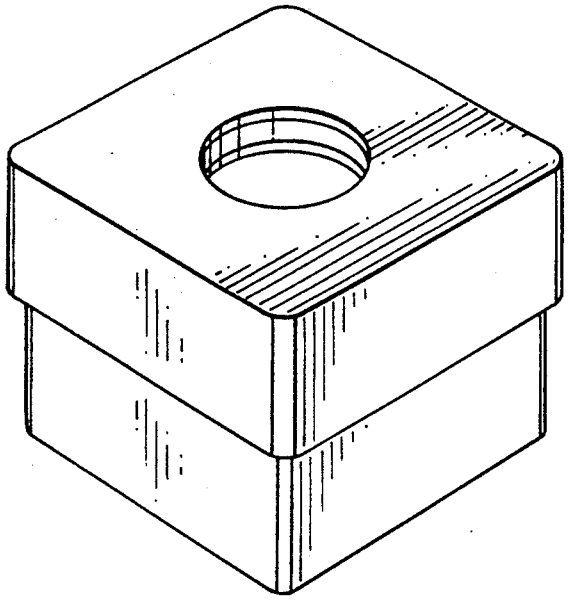
Fig. 1 PRIOR ART
FIG. 1 illustrates a structure of a clip case according to the prior art.
Figure 2:
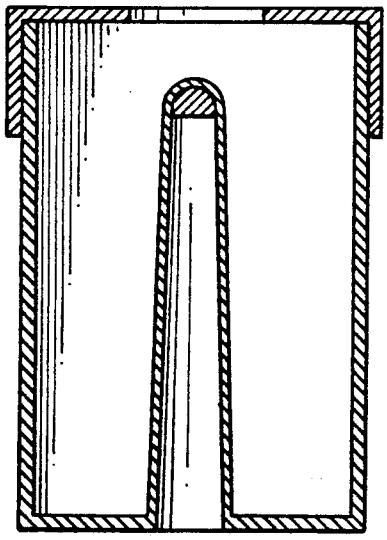
Fig. 2 PRIOR ART
FIG. 2 illustrates another structure of a clip case according to the prior art.
Figure 3:
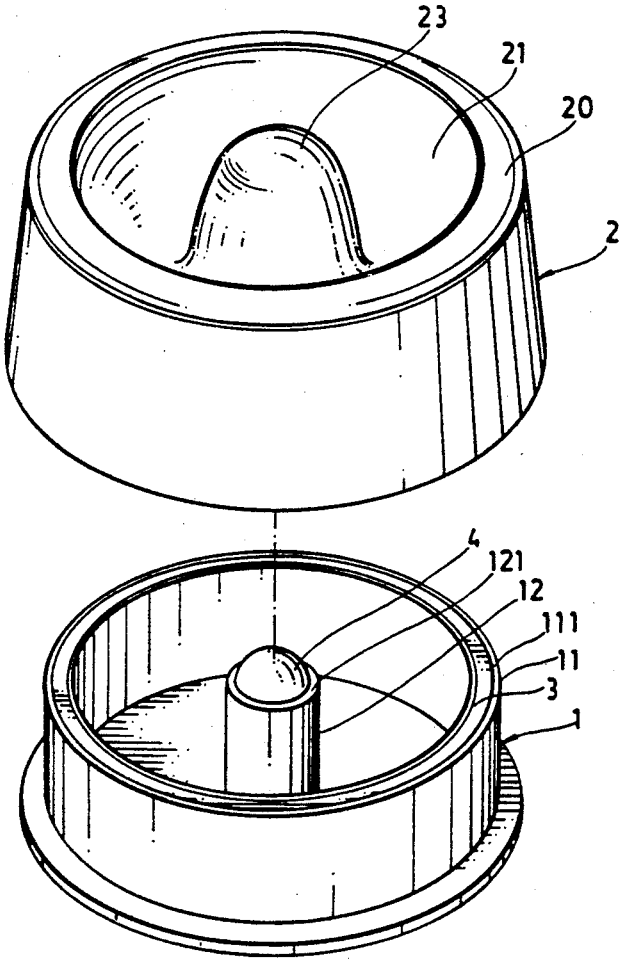
FIG. 3 is a perspective dismantled view of the preferred embodiment of the present invention.
Figure 4:
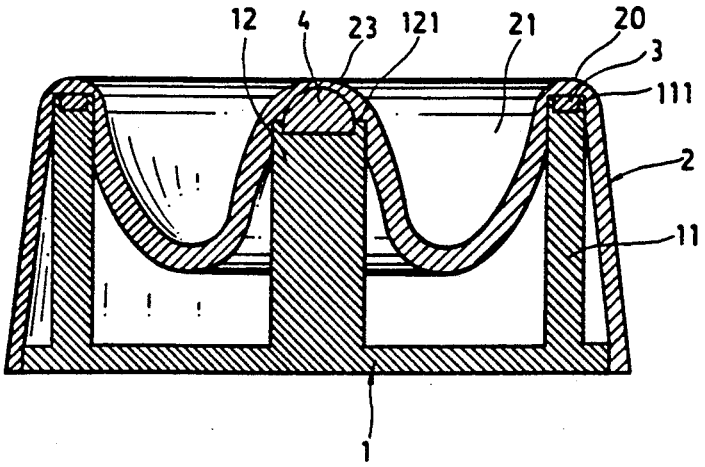
FIG. 4 is a sectional assembly view of the preferred embodiment of the present invention.

Referring to FIG. 3, there is shown the preferred embodiment of the clip container according to the present invention, which is generally comprised of a base 1 and a casing 2. The casing 2 covers the base 1 and can retain clips, pins or other small metal accessories. A concave surface portion 21 is formed on the top of the casing 2 and surrounded by an annular top edge 20, defining therein a hollow, conical projection 23 at the center thereof. The topmost edge of the hollow, conical projection 23 may be made at a level equal to, slightly higher or slightly lower than the topmost edge of the annular top edge 20. The concave surface portion 21 which is defined between the annular top edge and the hollow, conical projection 23 is provided for holding clips 9. The base 1 has a raised wall 11 around the periphery thereof and a unitary post 12 at the center thereof, respectively provided for supporting the annular top edge 20 and the hollow conical projection 23 of the casing 2. The height of the raised wall 11 and the post 12 is equal to or slightly smaller than the height of the hollow conical projection 23 or the annular top edge 20, so that the casing 2 can be securely mounted on the raised wall 11 of the base 1. The raised wall 11 and the post 12 have each an groove 111 or 121 on the topmost edge thereof for holding a magnetic element 3 or 4. Groove 111 is annular and groove 121 is circular. After the casing 2 is mounted on the base 1, the magnetic elements 3 and 4 respectively abut the inner bottom surface of the annular top edge 20 and the topmost inner bottom surface of the hollow conical projection 23 to provide a magnetic line of force (as shown in FIG. 4). The grooves 111 and 121 can respectively have a magnetic element 3 or 4 fastened thereto, or only one of the grooves can have with a magnetic element fastened thereto.

Figure 5:
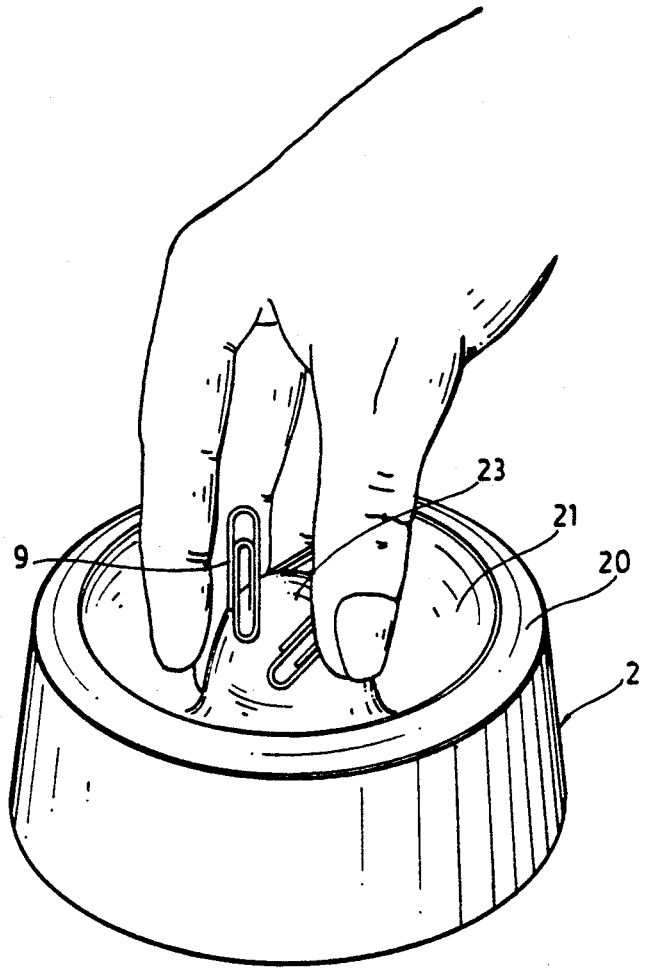
FIG. 5 illustrates the use of the present invention for grasping clips through the hollow, conical projection.
Figure 6:
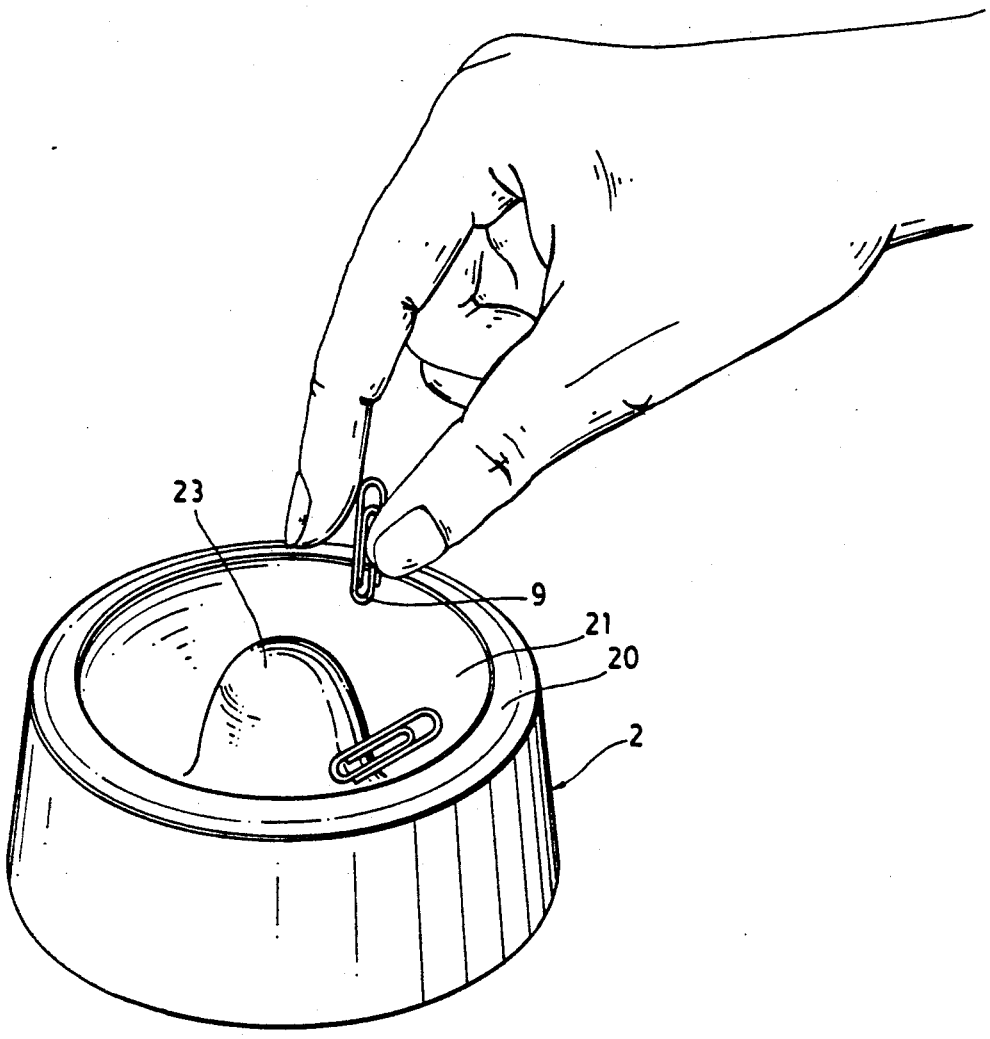
FIG. 6 illustrates the use of the present invention in picking up a clip by moving it from the concave surface portion toward the annular top edge of the casing.

The use of the present invention is shown in FIGS. 5 and 6. As shown in FIG. 5, fingers are respectively inserted in the concave surface portion 21 of the casing 2 to move clips 9 from the lowest area in the concave surface portion 21 toward the hollow, conical projection 23. By means of the effect of the magnetic element 4 on the circular groove 121 of the post 12, the clips 9 which are moved by the fingers are attracted to the top of the hollow, conical projection 23, and therefore, they can be conveniently grasped by fingers. Referring to FIG. 6, the forefinger is inserted in the concave surface portion 21 of the casing 2 to move a clip 9 from the concave surface portion 21 toward the annular top edge 20 permitting it to be attracted to the annular top edge 20 by the magnetic element 3 on the annular groove 111 of the raised wall 11, and therefore, a clip 9 can be conveniently grasped with the forefinger and the thumb.

If the hollow, conical projection 23 is designed to have a much shorter than the height of the annular top edge 20, the clips put in the concave surface portion 21 may cover over the top edge of the hollow, conical projection 23. In this case, it is more conveniently to move clips toward the annular top edge 20 for grasping. When only a small number of clips are left in the concave surface portion 21, they can be conveniently moved with fingers toward the top edge of the hollow, conical projection for grasping.

As indicated, various modifications could be made to the present invention without departing from the basic teaching thereof. The scope of the present invention shall be deemed as defined in the claims set forth hereinafter.

I claim:

1. A clip container for holding clips or small metal accessories comprising a casing mounted on a base, said casing having an annular top edge around a periphery thereof defining therein a concave surface portion, said concave surface portion having a hollow conical projection at a center thereof; said base having a raised wall around a periphery thereof and a unitary post at a center thereof for respectively supporting said annular top edge and said hollow conical projection, said raised wall having an annular groove on a topmost edge thereof with a magnetic element fastened thereto and abutting an inner bottom surface of said annular top edge for providing a magnetic force for attracting the clips moved from said concave surface portion toward said annular top edge.

2. The clip container of claim 1, wherein said hollow conical projection has a height equal to that of said annular top edge.

3. The clip container of claim 1, wherein said hollow conical projection has a height higher than that of said annular top edge.

4. The clip container of claim 1, wherein said hollow conical projection has a height lower than that of said annular top edge.

5. A clip container for holding clips or small metal accessories comprising a casing mounted on a base, said casing having an annular top edge around a periphery thereof defining therein a concave surface portion, said concave surface portion having a hollow conical projection at a center thereof; said base having a raised wall around a periphery thereof and a unitary post at a center thereof for respectively supporting said annular top edge and said hollow conical projection, said post having a circular groove on a topmost edge thereof with a magnetic element fastened thereto and abutting against a topmost inner bottom surface of the hollow conical projection for providing a magnetic force for attracting the clips moved from said conical surface portion toward said hollow conical projection.

6. The clip container of claim 5, wherein said hollow conical projection has a height equal to that of said annular top edge.

7. The clip container of claim 5, wherein said hollow conical projection has a height higher than that of said annular top edge.

8. The clip container of claim 5, wherein said hollow conical projection has a height lower than that of said annular top edge.

9. A clip container for holding clips or small metal accessories comprising a casing mounted on a base, said casing having an annular top edge around a periphery thereof defining therein a concave surface portion, said concave surface portion having a hollow conical projection at a center thereof; said base having a raised wall around a periphery thereof and a unitary post at a center thereof for respectively supporting said annular top edge and said hollow conical projection, said raised wall having an annular groove and said post having a circular groove on topmost edges thereof with a magnetic element respectively fastened thereto and respectively abutting an inner bottom surface of said annular top edge and a topmost inner bottom surface of said hollow conical projection for providing a magnetic force for attracting the clips moved from said concave surface portion toward said annular top edge and said hollow conical projection.

10. The clip container of claim 9, wherein said hollow conical projection has a height equal to that of said annular top edge.

11. The clip container of claim 9, wherein said hollow conical projection has a height higher than that of said annular top edge.

12. The clip container of claim 9, wherein said hollow conical projection has a height lower than that of said annular top edge.

* * * * *